United States Patent [19]

Hirsch

[11] 4,008,851

[45] Feb. 22, 1977

[54] ADHESIVE TAPE BAG CLOSURE

[75] Inventor: John L. Hirsch, Sheboygan Falls, Wis.

[73] Assignee: Curt G. Joa, Inc., Sheboygan Falls, Wis.

[22] Filed: Jan. 16, 1976

[21] Appl. No.: 649,879

[52] U.S. Cl. ..... 229/62; 24/30.5 P; 206/813; 24/30.5 R;30.5 P

[51] Int. Cl.[2] ..... B65D 33/24

[58] Field of Search ..... 229/62, 80; 206/813

[56] References Cited

UNITED STATES PATENTS

| | | | |
|---|---|---|---|
| 2,088,232 | 7/1937 | Cumming | 229/62 |
| 3,806,024 | 4/1974 | Maarchesani | 229/62 |

*Primary Examiner*—Stephen P. Garbe
*Attorney, Agent, or Firm*—Joseph P. House, Jr.

[57] ABSTRACT

A strip of adhesive tape is relatively permanently attached at one end to a bag near the open end thereof and is strippably attached to the bag in the remaining portions of the tape. To close the bag, the strippable portion of the tape is stripped away from the bag, which is then puckered and desirably twisted near the tape. The free end of the tape is then looped around the puckered end of the bag and is fastened by its adhesive to the puckered portion of the bag and/or to the anchored end of the tape, thus to close the bag.

2 Claims, 8 Drawing Figures

Fig. 1
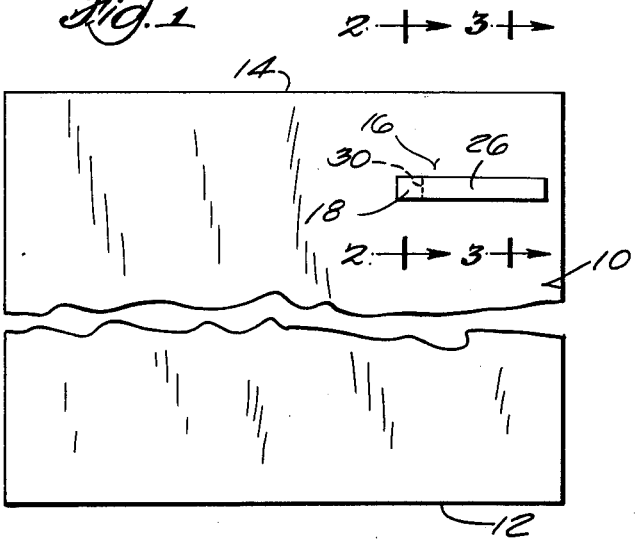
Fig. 2
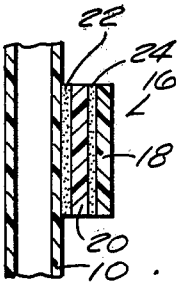
Fig. 3
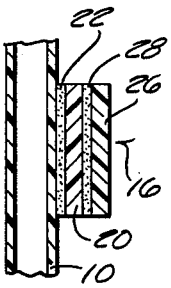
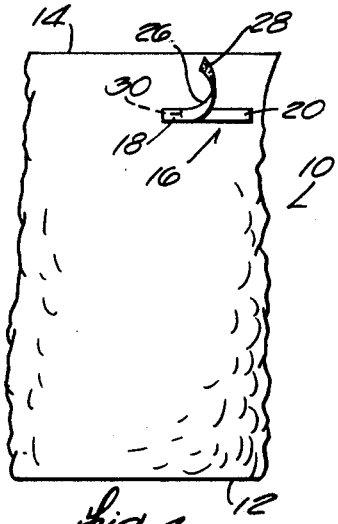
Fig. 4
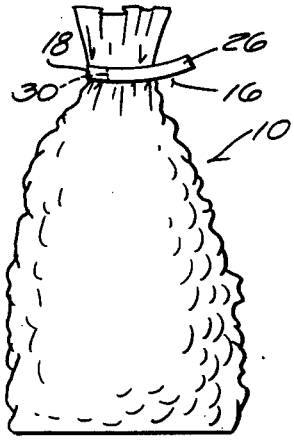
Fig. 5
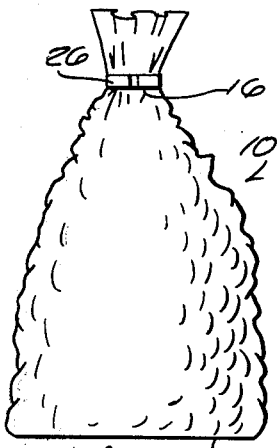
Fig. 6
Fig. 7
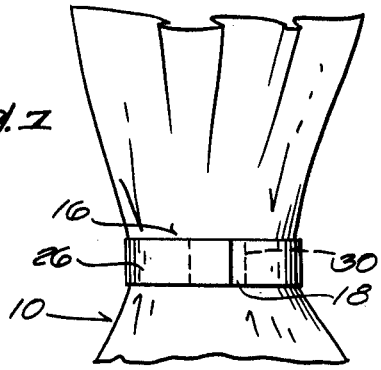
Fig. 8
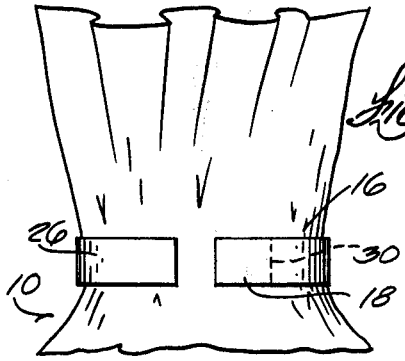

ADHESIVE TAPE BAG CLOSURE

BACKGROUND OF THE INVENTION

This invention relates to closures for plastic trash bags or other bags which can be closed by puckering the open end of the bag and tying it closed. In the past, paper covered wire closure ties have been used for tying such bags closed. Such closure ties have been furnished by the manufacturer in packages of plastic trash bags, but this arrangement is inconvenient because the ties become lost or misplaced. Flexible tie strips which are attached to the bag so as to be at hand when needed have been suggested in the past, as disclosed in U.S. Pat. Nos. 2,849,171 and 3,412,926, but these ties also have drawbacks. The tie member disclosed in U.S. Pat. No. 2,849,171 has to be knotted by hand. The tie member disclosed in U.S. Pat. No. 3,412,926 is intended to be completely stripped off the bag before use at a different place on the bag.

SUMMARY OF THE INVENTION

In accordance with this invention, the foregoing drawbacks have been overcome by relatively permanently fastening one end of an adhesive tape strip to a bag near the open end thereof at a location where the bag can be puckered to close the open end. The other end of the adhesive tape strip is strippably adhered to the bag. To close the bag, the strippable portion of the tape is stripped away from the bag, which is then puckered near the tape, both hands being available for puckering due to the fact that the adhesive tape strip is still attached at one end of the bag and does not become displaced or disoriented. The free end of the tape is then looped around the puckered end of the bag and is fastened by its adhesive to the puckered portion of the bag and/or to the anchored end of the tape, thus to close the bag.

Other objects, features and advantages of the invention will appear from the disclosure hereof.

DESCRIPTION OF THE DRAWINGS

FIG. 1 is a side view of a flattened plastic bag having an adhesive strip of this invention attached near the open end thereof.

FIG. 2 is a fragmentary enlarged longitudinal sectional view taken on the line 2—2 of FIG. 1.

FIG. 3 is a fragmentary enlarged longitudinal sectional view taken on the line 3—3 of FIG. 1.

FIG. 4 is a side view of the bag of FIG. 1 filled with trash and having the strippable portion of the adhesive strip stripped away from the bag in preparation for closing it.

FIG. 5 shows the top of the bag puckered and the tape partially looped around the bag neck formed by the puckered or twisted end.

FIG. 6 is a side view similar to FIG. 5 showing the adhesive strip completely encircling the puckered top and fastened to its anchored end.

FIG. 7 is an enlarged fragmentary side view of the puckered neck portion of the bag showing the strippable portion of the adhesive strip fastened to the puckered portion of the bag and also fastened to the anchored end of the adhesive strip.

FIG. 8 is an enlarged fragmentary side view of the puckered neck portion of the bag showing the strippable portion of the adhesive strip fastened to the puckered portion of the bag, but not fastened to the anchored end of the adhesive strip.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

FIG. 1 is a side view of an elongated flattened plastic film bag 10 having a closed bottom end 12 and an open top end 14. Bag 10 can have any suitable dimensions and proportions, depending on its intended use.

In accordance with this invention, a flexible closure tape 16 is relatively permanently attached at one end 18 to bag 10 near open end 14 thereof in a position where the top of bag 10 can be conveniently puckered in preparation for closure after filling. A foundation or release strip 20 (FIGS. 2 and 3) which extends the full length of closure tape 16 and has the same width is relatively permanently attached to the wall of bag 10 by a suitable adhesive layer 22, and a short end portion 18 of closure tape 16 is relatively permanently attached to the outer surface of foundation strip 20 by a suitable adhesive layer 24 (FIG. 2). Adhesive layers 22 and 24 are both of the type that relatively permanently adhere to both adjacent surfaces to relatively permanently join the adjacent surfaces together in contrast to strippable means which strippably joins two surfaces together. The use of such relatively permanent adhesive layers 22 and 24 have the effect of relatively permanently attaching the short end portion 18 of closure tape 16 to the outside of bag 10 at the desired location.

The remaining longer portion 26 (FIGS. 1 and 3) of closure tape 16 is strippably adhered to foundation or release strip 20 by a suitable adhesive layer 28 which adheres relatively permanently to the inner surface of closure tape portion 26 but only strippably adheres to the adjacent outer surface of foundation strip 20, which preferably has a relatively smooth, waxy or silicone coated outer surface to enhance strippability. The boundary between the relatively permanent adhesive layer 24 and the strippable adhesive layer 28 on closure tape 16 is indicated in FIG. 1 by the broken line 30.

It should be noted here that the thickness of the adhesive layers 22, 24, and 28, along with the thickness of foundation strip 20 and closure tape 26, have all been exaggerated in FIGS. 2 and 3 for illustration purposes.

FIGS. 4–6 show steps in the preferred method of closing the top of a filled bag 10 with closure strip 16. First, the strippable portion 26 of closure tape 16 is stripped away from release strip 20 as shown in FIG. 4 up to the line 30 that marks the boundary between strippable adhesive layer 28 and relatively permanent adhesive layer 24. Strippable adhesive layer 28 remains adhered to the inner surface of closure tape portion 26 when it is stripped away from release strip 20 as shown in FIG. 4. The strippable portion 26 of closure tape 16 is then allowed to hang supported by the anchored portion 18 thereof while both hands are used to pucker the top of bag 10 and then to twist it to reduce the diameter of the puckered portion in the form of a neck in line with closure tape 16, as shown in FIG. 5. The puckered and twisted portion of bag 10 is then held in position with one hand while the other hand is used to grasp the stripped end 26 of closure tape 16 and loop it around the neck of the puckered and twisted portion of bag 10 while pressing the closure tape portion 26 against bag 10 to cause adhesive layer 28 to adhere thereto to seal the top of bag 10 closed. Preferably, the end of closure tape portion 26 will overlap the anchored closure tape portion 18 as shown in FIG. 7. However, the adhesive layer 28 will also hold the bag top closed if the end of closure tape portion 26 does not quite reach the anchored closure tape portion 18 as shown in FIG. 8.

What is claimed is:

1. The combination of a bag and bag closure in which the bag closure comprises an elongated flexible closure tape, means relatively permanently attaching one end portion of said tape to the bag near its open end, a strippable adhesive means between said tape and said bag in the area where the tape is not relatively permanently attached to said bag, whereby the portion of said tape which is not relatively permanently attached to said bag is strippably attached thereto and can be subsequently stripped away from said bag to serve as an adhesive closure tape for said bag, the portion of said tape which is relatively permanently attached to said bag serving as an anchor for said adhesive closure tape, a flexible foundation strip between said closure tape and said bag, said foundation strip being relatively permanently attached to the outer surface of said bag, and said one end portion of said closure tape being relatively permanently attached to a portion of the outer surface of said foundation strip, the outer surface of another portion of said foundation strip comprising a release surface for said strippable adhesive means.

2. The combination of claim 1 wherein said flexible foundation strip has substantially the same width and length as said flexible closure tape.

* * * * *